US010427811B2

(12) United States Patent
Goldbrunner et al.

(10) Patent No.: US 10,427,811 B2
(45) Date of Patent: Oct. 1, 2019

(54) DEVICE FOR FILLING A CONTAINER

(71) Applicant: KRONES AG, Neutraubling (DE)

(72) Inventors: Christian Goldbrunner, Au (DE); Manfred Faltermeier, Elsendorf (DE); Stefan Koller, Bad Abbach (DE); Thomas Schuhbeck, Hemau (DE)

(73) Assignee: KRONES AG, Neutraubling (DE)

( * ) Notice: Subject to any disclaimer, the term of this patent is extended or adjusted under 35 U.S.C. 154(b) by 12 days.

(21) Appl. No.: 15/061,917

(22) Filed: Mar. 4, 2016

(65) Prior Publication Data

US 2016/0257436 A1 Sep. 8, 2016

(30) Foreign Application Priority Data

Mar. 5, 2015 (DE) ..... 10 2015 103 227

(51) Int. Cl.
*B65B 3/12* (2006.01)
*B65B 3/32* (2006.01)
(Continued)

(52) U.S. Cl.
CPC ..... *B65B 3/12* (2013.01); *B65B 3/14* (2013.01); *B65B 3/32* (2013.01); *B65B 39/004* (2013.01); *B67C 3/206* (2013.01); *B67C 3/2608* (2013.01)

(58) Field of Classification Search
CPC .. B67C 3/206; A23G 9/28; B65B 3/12; B65B 3/14; B65B 3/32
See application file for complete search history.

(56) References Cited

U.S. PATENT DOCUMENTS 1,473,979 A * 11/1923 Simmons ..... A61M 3/0233 128/DIG. 12
2,563,863 A 8/1951 Nordquist
(Continued)

FOREIGN PATENT DOCUMENTS

DE 1929589 12/1969
DE 2453312 6/1975
(Continued)

OTHER PUBLICATIONS

Brennan et al., "Food Processing Handbook", Weinheim: Wiley-VCH, 2nd edition, vol. 1, 2012, p. 539, ISBN 978-3-527-32468-2.
(Continued)

*Primary Examiner* — Andrew D Stclair
(74) *Attorney, Agent, or Firm* — Haynes and Boone, LLP

(57) ABSTRACT

A device for filling a container with a fill product, for example a fill product that is viscous and contains particles, is described. The device includes a fill product reservoir for accommodating the fill product that is to be filled, a dosing cylinder within which a dosing piston is displaceably accommodated for dosing the fill product, and a discharge channel with an outlet end for discharging the fill product into the container that is to be filled. The discharge plunger is disposed in the discharge channel for expelling a product residue at the end of the filling process, and the fill product reservoir, the dosing cylinder, and the discharge channel are in communication with each other via a common product channel. A valve for opening and closing the connection between the fill product reservoir and the product channel is disposed in the base of the fill product reservoir.

18 Claims, 3 Drawing Sheets

(51) Int. Cl.

| | |
|---|---|
| ***B67C 3/20*** | (2006.01) |
| ***B67C 3/26*** | (2006.01) |
| ***B65B 3/14*** | (2006.01) |
| ***B65B 39/00*** | (2006.01) |

(56) References Cited

U.S. PATENT DOCUMENTS

| | | | | | |
|---|---|---|---|---|---|
| 3,456,839 | A * | 7/1969 | Glisenti | A23G 9/166 | 222/146.1 |
| 3,760,853 | A * | 9/1973 | Trusselle | B65B 3/12 | 141/146 |
| 3,868,050 | A * | 2/1975 | Gorychka | A23G 9/281 | 222/509 |
| 4,230,160 | A | 10/1980 | Buckley | | |
| 4,466,557 | A | 8/1984 | Marchadour et al. | | |
| 4,676,279 | A * | 6/1987 | von Lersner | B65B 3/32 | 137/240 |
| 5,107,907 | A | 4/1992 | Marchadour | | |
| 5,230,373 | A | 7/1993 | Engler | | |
| 5,400,927 | A | 3/1995 | Marchadour | | |
| 6,299,025 | B1 * | 10/2001 | Watanabe | A23G 9/22 | 222/146.6 |
| 2002/0088826 | A1 * | 7/2002 | Barker | B67D 1/1416 | 222/129.1 |
| 2005/0173462 | A1 * | 8/2005 | Stumler | A23G 9/228 | 222/380 |

FOREIGN PATENT DOCUMENTS

| | | | |
|---|---|---|---|
| EP | 1698558 | | 9/2006 |
| FR | 2708563 | * | 2/1995 |
| FR | 2925022 | | 6/2009 |
| JP | 62188495 | | 12/1987 |
| JP | 2000308470 | | 11/2000 |
| JP | 2000313404 | | 11/2000 |

OTHER PUBLICATIONS

Search Report, German Patent Application No. 102015103227.9, dated Mar. 5, 2015, 7 pages.

Search Report, European Patent Application No. 16158608.6, dated Jul. 8, 2016, 7 pages.

Office Action issued in Chinese Patent Application No. 201610127359.4 dated Nov. 29, 2017.

Office Action issued in Chinese Patent Application No. 201610127359.4 dated Jan. 24, 2019, 7 pages.

* cited by examiner

DEVICE FOR FILLING A CONTAINER

CROSS REFERENCE TO RELATED APPLICATION

This application claims priority from German Patent Application No. DE 10 2015 103 227.9, filed on Mar. 5, 2015 in the German Patent and Trademark Office, the disclosure of which is incorporated herein by reference in its entirety.

BACKGROUND

Technical Field

The present invention relates to a device for filling a container, and in particular a piston filler, which is provided for use in a rotary foodstuff filling plant in several embodiments.

Related Art

In order to fill viscous foodstuffs or beverages, in particular high viscosity foodstuffs such as for example jams, yogurts, ketchups, mayonnaise, cream etc., it is known to carry out the filling of the high viscosity foodstuffs by means of piston fillers. Piston fillers are also used for filling viscous foodstuffs that contain solids, such as for example pieces of fruit or chocolate, cereals, or other solids that are filled in conjunction with foodstuffs.

The use of piston fillers for filling viscous fill product has the advantage that the viscous fill products, which would otherwise not flow out, or would flow out only very slowly, can be dispensed into the containers that are to be filled at a specified speed corresponding to the timing of the applicable filling plant. Furthermore, by using the dosing piston of the piston filler it is possible to achieve precisely dosed filling, so that the fill product can be introduced with the intended fill volume, fill weight or fill height into the containers to be filled.

Various configurations of piston fillers are known. From DE 24 53 312 A1, for example, a rotary piston filler is known in which the flow of the fill product from a fill product reservoir into the dosing cylinder is controlled by means of a plunger that is provided with an appropriate valve opening. In this case the plunger serves both as a valve for controlling the flow of fill product and as a discharge plunger for expelling residues of fill product from the discharge channel.

From JP 200-308470 A1, a piston filler is known in which a rotary valve disposed below the fill product reservoir controls the flow of fill product between the fill product reservoir, the dosing cylinder and the discharge channel. The rotary valve has a horizontally oriented axis of rotation.

Additionally known, for example under the designation Viscofill V from KRONES AG, is a piston filler which uses a rotary valve with a vertically oriented axis of rotation for controlling the flow of fill product from a fill product reservoir into a discharge channel.

Further known, for example under the designation Viscofill S from KRONES AG, is a piston filler in which a pneumatically actuated seat valve for controlling the flow of fill product from the fill product reservoir into the dosing cylinder is provided in the base of the fill product container, and below the dosing cylinder another seat valve is provided, through which the fill product can flow out into the container that is to be filled.

The known piston fillers which have rotary valves oriented vertically or horizontally require elaborate cleaning, since each rotary valve must be removed completely from its valve seat for every cleaning procedure, for example by extracting the rotary valve from a corresponding rotary valve housing. In addition, twice in each and every dosing procedure the rotary valves are rotated by approximately 180°, which may result, depending on the fill product that is filled, in increased wear.

Furthermore, in the known systems the passages to the respective dosing cylinders are located in the frame of the product hopper. Because of this, the product can be sucked into the dosing cylinder only up to the top of the passages, with the result that it may be necessary to discard fill product from the base area of each fill product reservoir at the end of the filling process.

In the known piston dosers or fillers with seat valves, the free passage diameter for the fill product that is to be dosed is determined by the annular gap in the valves, with the result that the maximum particle diameter is limited. In addition, due to the fact that the seat valve is provided at the fill product outlet, when fill products containing solids are filled it is not possible to achieve defined division of the solids. Instead, solids can be trapped or squashed in the seating of the valve between the valve body and the valve seat, which can detract from the quality of the fill product and lead to subsequent dripping or uncontrolled falling of the squashed residues of solids.

SUMMARY

A device for filling a container with a viscous fill product that has improved properties in comparison with the devices known from the state of the art is described.

Accordingly, a device for filling a container with a fill product, for example for filling with a fill product that is viscous and contains particles, is proposed, comprising a fill product reservoir for accommodating the fill product that is to be filled, a dosing cylinder within which a dosing piston is displaceably accommodated for dosing the fill product, and a discharge channel with an outlet end for discharging the fill product into the container that is to be filled, wherein a discharge plunger is disposed in the discharge channel for expelling a product residue at the end of the filling process, and the fill product reservoir, the dosing cylinder and the discharge channel are in communication with each other via a common product channel. According to the present invention, a valve for opening and closing the connection between the fill product reservoir and the product channel is disposed in the base of the fill product reservoir.

Due to the fact that in the device a valve for opening and closing the connection between the fill product reservoir and the product channel is disposed in the base of the fill product reservoir, and in addition a discharge channel with a discharge plunger is provided at the fill product outlet, viscous fill products can be filled gently and precisely. In particular, fill products that contain solids, in particular large, deformable solids such as for example cherries, can be filled gently and precisely by means of the device described herein. The disadvantages of known piston fillers that are provided with two seat valves are overcome by the provision of the discharge channel with the discharge plunger, since in the shearing areas provided by the discharge plunger, precise and clean separation or division of the solids takes place by means of the discharge plunger when the discharge channel is closed. Accordingly, squashing of the solids no longer occurs, which results in a higher product quality, and in particular the filled container no longer contains solids that have been squashed or separated in an undefined manner.

The device can also be cleaned in a simple manner, since the elaborate process of disassembling the rotary valve is no longer required. Instead, the seat valve disposed in the base of the fill product reservoir can be rinsed with cleaning media in a conventional manner, without disassembly of the device being necessary. This is because, in contrast to a rotary valve, all surfaces of an open seat valve that come into contact with the product can be fully exposed to a flow of the cleaning medium without the need to disassemble the device.

The discharge channel and the discharge plunger can also be rinsed simply in a known manner, without the necessity for elaborate disassembly. The discharge plunger can simply be pulled out of the discharge channel so that all surfaces that come into contact with the product can be rinsed, without the need to disassemble the device as a whole in an elaborate manner.

In addition, the wear characteristics of the device are improved, since in place of the wear-prone rotary valve a low-wear seat valve can be used.

Due to the fact that the valve is disposed in the base of the fill product reservoir, it is furthermore ensured that all of the fill product that is contained in the fill product reservoir can flow out through the valve in the base of the fill product reservoir and be dosed into the container. The amount of fill product residue that remains is determined only by the adhesion of the fill product in the fill product reservoir due to its high viscosity. It is not determined by the fill product being drawn from a position which necessarily causes a residue of fill product to be left in the fill product reservoir in every case, to an extent defined by the height of the aperture from which it is drawn.

The valve is, in one embodiment, a seat valve and/or a poppet valve, and the valve, in certain embodiments, has a valve disk that can be lowered sealingly into a valve seat disposed in an aperture disposed in the base of the fill product reservoir. In this manner the valve can be implemented such that it is both reliable and simple to clean.

Individual control of the valve can be achieved in that the valve is actuated individually by a mechanical, pneumatic, electropneumatic, electromotive or electromagnetic drive.

Uncontrolled outflow of the fill product can be prevented by the discharge channel being in communication with the dosing cylinder via a siphon-like section of the product channel. This siphon-like section, in certain embodiments, tapers from its end which faces the dosing cylinder to its end which faces the discharge channel, and particularly, in some embodiments, has a continuously tapering design.

In order to prevent or reduce the entry of air into the discharge channel and into the siphon-like section of the product channel, a lower blocking edge of the siphon-like section of the product channel is, in some embodiments, disposed at a level below the level defined by the lower dead center of the dosing piston. In this manner it can also be achieved that air cannot enter the discharge channel, in which inaccurate dosing or splattering would occur when the air bubble escaped through an outflow aperture while the container to be filled was being filled. In this manner more exact and clean filling of the container to be filled can therefore be achieved.

In order to prevent or reduce any accumulation of air in the dosing piston or the shared product channel, the aperture in the base of the fill product reservoir is, in several embodiments, disposed at a higher level than the level defined by the lower dead center of the dosing piston. In this manner, air that accumulates in the dosing cylinder or the product channel can flow back into the fill product reservoir via an opened valve in the base of the fill product reservoir. This ensures that the common product channel and the dosing cylinder can be ventilated in this manner during each dosing procedure, so that the total quantity of air that accumulates in the system can be kept low, or else accumulation can be completely prevented.

Particularly, in some embodiments, a drainage aperture which can be closed by means of a shut-off device is provided in the base of the product channel. By this means it can be achieved that when the device is cleaned the common product channel is also completely emptied of cleaning medium, in particular in the case of a common product channel that has a siphon-like design, so that the common product channel can be completely emptied of cleaning medium in the same manner as the discharge channel and the dosing cylinder. The aperture with the shut-off device accordingly forms, at least in the case of each individual device, the lowest point of the device, with the result that all of the cleaning medium can drain out.

For individual control, the discharge plunger can be actuated individually by a mechanical, pneumatic, electropneumatic, electromotive or electromagnetic drive, wherein particularly, in various embodiments, a control of the drive is configured such that if there is a gap in the supply of containers the discharge plunger remains in the lowered position.

Between the siphon-like section of the product channel and the discharge channel a shearing edge may be formed, which cooperates with the discharge plunger. By means of the shearing edge, when the discharge plunger is lowered it is possible to achieve a defined shearing off of components of the fill product, in particular fill product particles. As a result, a clean filling outcome, without squashing, is achieved.

In a further embodiment, during cleaning of the device, the valve is controlled to adopt the open position, the discharge plunger is removed from the discharge channel, and the dosing piston is removed from the dosing cylinder. In particular, no disassembly of the components of the housing takes place, with the result that cleaning can be carried out in a simple manner.

BRIEF DESCRIPTION OF THE FIGURES

Further embodiments and aspects of the present invention are more fully explained by the description below of the figures.

DETAILED DESCRIPTION

Examples of embodiments are described below with the aid of the figures. In the figures, elements which are identical or similar, or have identical effects, are designated with identical reference signs, and repeated description of these elements is in part dispensed with in order to avoid redundancy.

Figure 1:
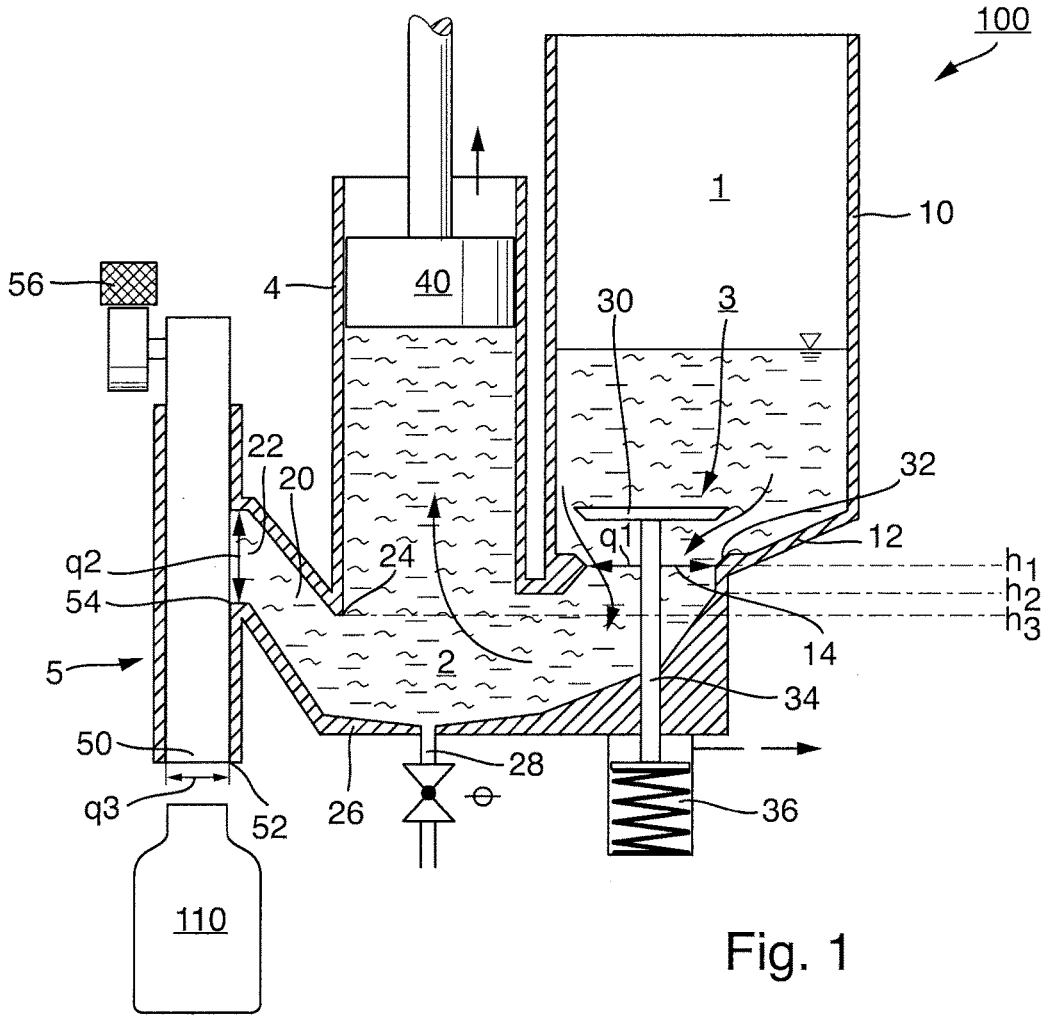
FIG. 1 shows a device for filling a container in a first operating state during the filling of the dosing cylinder with fill product from the fill product reservoir.

FIG. 1 shows a device 100 for filling a schematically shown container 110 with a viscous fill product, in particular a high viscosity foodstuff containing particles or solids, for example a yogurt containing whole cherries. The viscous fill product is supplied for filling in a fill product reservoir 1, which has side walls 10 and a base 12. The fill product reservoir 1 can be for example a product bowl of a rotary filler in a filling plant, in which case a plurality of devices 100 would typically be disposed as filling elements around the circumference of the fill product reservoir 1, and rotate with it during the production process.

In the base 12 of the fill product reservoir 1, an aperture 14 is provided, through which the fill product can flow into a product channel 2. The aperture 14 can be closed by a valve 3. In the example embodiment shown, the valve 3 has a valve disk 30 and a valve seat 32 which is disposed around the circumference of the aperture 14 in the base 12 of the fill product reservoir 1. The valve disk 30 can be lowered into the valve seat 32 such that it forms a seal, or raised out of the valve seat 32 in order thereby to open the aperture 14 in the base 12 of the fill product reservoir 1 and allow fill product to flow out of the fill product reservoir 1 into the product channel 2.

The seat valve 3 that is used is less prone to wear than the rotary valves known from the state of the art, with the result that the device 100 has a lower-wear design.

Furthermore, the mechanical effort needed to construct the device 100 is considerably less than in the case of the devices known from the state of the art, with the result first that the costs and the moved mass can be reduced, and secondly that the reliability of operation can be improved.

The installation of the valve 3 in the base 12 of the fill product reservoir 1 also enables the fill product to be drawn out of the fill product reservoir 1 in its entirety.

The valve disk 30 is connected via a valve stem 34 with a valve actuator 36. The valve actuator 36 can be a mechanical, pneumatic, electropneumatic, electromotive or electromagnetic actuator, which enables reliable opening and closing of the valve 3 together with actuation of each valve 3 individually, for example in a rotary filler.

The product channel 2, which extends from the aperture 14 of the fill product reservoir 1 that can be closed by means of the valve 3, communicates with a dosing cylinder 4, in which a dosing piston 40 is disposed. The dosing piston 40 can be moved up and down within the dosing cylinder 4, and in this manner bring about change in the volume accommodated in the dosing cylinder 4. Accordingly, by raising the dosing piston 40 in the dosing cylinder 4, as indicated by the arrow in FIG. 1, fill product can be sucked from the fill product reservoir 1 through the opened valve 3 and the aperture 14 in the base of the fill product reservoir, through the product channel 2 into the dosing cylinder 4. The flow of fill product from the fill product reservoir into the dosing cylinder 4 that is provided in this manner is indicated by arrows in FIG. 1.

A discharge channel 5 is also provided, which communicates with the dosing cylinder 4 via a siphon-like section 20 of the product channel 2. In the operating state of the device 100 that is shown in FIG. 1, the discharge channel 5 is closed by a discharge plunger 50 that is lowered inside it. In this operating state, the discharge plunger 50 has been advanced to the outlet end 52 of the discharge channel 5, and accordingly fills the discharge channel 5 completely.

Figure 2:
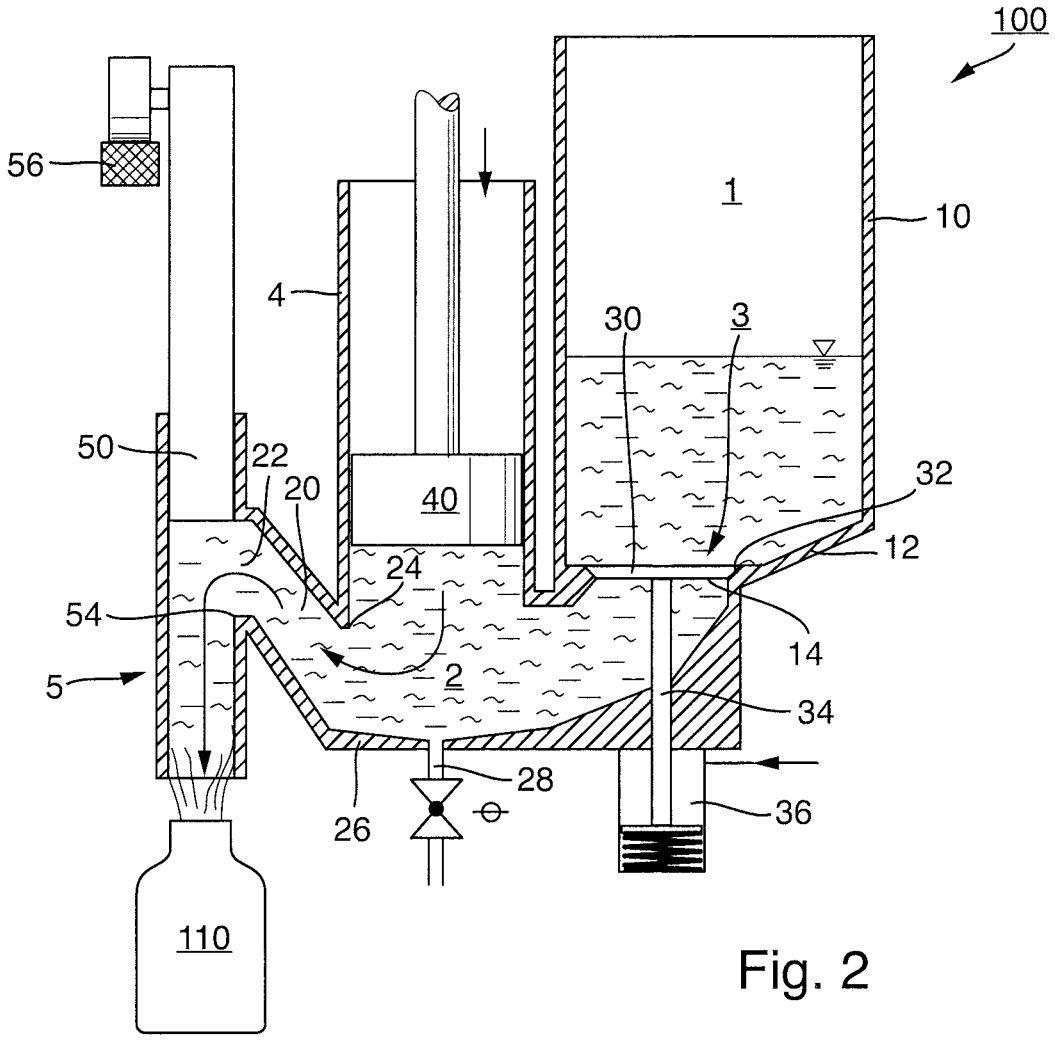
FIG. 2 shows the device in FIG. 1 in a second operating state, in which the dosing cylinder dispenses the fill product via the discharge channel into the container that is to be filled.

The siphon-like section 20 of the product channel 2 is connected with the discharge channel 5 via a connecting aperture 22, which, when the discharge plunger 50 is withdrawn, allows the fill product to pass through the discharge channel 5 to the outlet end 52, in order then to reach the container 110 that is to be filled. This operating state is also shown in FIG. 2.

The design of the product channel 2 with the siphon-like section 20 prevents uncontrolled emptying of the product into the container 110 that is to be filled.

At the connection between the siphon-like section 20 of the product channel 2 and the discharge channel 5, an intersection which provides a shearing edge 54 is formed in the area of the connecting aperture 22. At the shearing edge 54, the descending discharge plunger 50 can perform a shearing function, by means of which it is possible to shear off fill product, especially fill product containing particles. In particular, it is possible in this manner for flexible solids of fill product with relatively large volumes, such as for example cherries, to be sheared off cleanly at the shearing edge 54 by means of the discharge plunger 50, so that no squashing of these solids in the fill product takes place, and the fill product can be discharged in a clean and defined manner through the outlet end 52 into the container to be filled 110 that is disposed below.

The aperture 14 in the base 12 of the fill product reservoir 1 is disposed at a higher level h1 than the lower rim of the dosing cylinder 4, which also represents the lower dead center of the dosing piston 40. In this manner it can be achieved that air which may be contained in, or accumulate in, the dosing cylinder 4, is forced out of the dosing cylinder 4 by the dosing piston 40 on discharge, i.e. by the downwards movement of the dosing piston 40 within the dosing cylinder 4. Because the valve 3 is normally closed during discharge of the fill product, the air that is forced out of the dosing cylinder 4 collects below the closed valve 3. When the valve 3 next opens, for example in the next filling cycle, the air can be pushed back through the valve 3 into the fill product reservoir 1. Accordingly, accumulation of air in the dosing cylinder 4 can be reduced or prevented.

The siphon-like section 20 of the product channel 2 has a lower blocking edge 24, whose level is h3, which is below the lower dead center of the dosing piston 40, indicated by level h2. In this manner it can be ensured that air forced out of the dosing cylinder 4 by means of the dosing piston 40 when the dosing piston 40 moves downwards does not rise in the siphon-like section 20 of the product channel 2. Instead, the air can flow back or be pushed back into the fill product reservoir 1 via the aperture 14 in the base 12 of the fill product reservoir 1, which is disposed both above the lower blocking edge 24 and above the lower dead center of the dosing piston 40. In this manner the entry of air into the siphon-like section 20 and thereby also into the discharge channel 5 is reduced or fully prevented. Clean filling of the fill product can thereby be achieved, in particular due to the fact that the outlet end 52 does not emit a mixture of air and fill product, which could increase the tendency of the fill product to splatter during filling. Furthermore, it can be ensured by this means that a defined volume is reliably filled, without being compromised by the presence of a relatively large air bubble.

In the base area 26 of the product channel 2, a drainage aperture 28 is provided, which is closed by means of a suitable shut-off device. The drainage aperture 28 is, in various embodiments, provided at the lowest point of the product channel, and enables the draining of fill product that is still present in the product channel 2 on conclusion of a production cycle, and/or the full draining of a cleaning medium that has been used to clean the device 100. By this means a change of product or a suspension of production can be carried out with subsequent cleaning in each case, without the danger of carry-over of the cleaning medium that is used in each case, or of the previous fill product, and from the first container in the next production cycle the device 100 can fill a product that is unmixed with other substances.

In the example embodiment that is shown, the movement of the discharge plunger 50 is controlled by means of a guide rail 56, on which a corresponding roller of the discharge plunger 50 is guided. The discharge plunger 50 can however also be equipped with any other type of actuator, in particular with any individual mechanical, hydraulic, electrical, magnetic or other type of actuator that can be individually controlled.

By means of the use of the valve 3 in the form of a poppet valve with a valve disk 30 in combination with a corresponding design of the valve seat 32, and the embodiment of the fill product reservoir 1 in the area of its base 2 in the form of a hopper, it can be achieved that the annular gap that is formed between the valve disk 30 and the valve seat 32 is significantly greater than the gap that is provided by the seat valves that are used in the state of the art, which use smaller valve bodies. By this means it can be ensured that fill product containing larger particles, in particular larger elastic particles such as for example cherries, can pass through the annular gap without problems and accordingly enter the product channel 2 through the aperture 14 in the base 12 of the fill product reservoir 1.

The product channel 2 has a larger cross section q1 in the area of the aperture 14 in the base 12 of the fill product reservoir 1 than in the area of the connecting aperture 22, which is provided with a cross section q2. There is a substantially continuous reduction in cross section from the larger cross-section q1 of the aperture 14 in the base 12 of the fill product reservoir 1 to the smaller cross-section q2 of the connecting aperture 22, and finally to the cross section q3 at the outlet end 52 of the discharge channel 5. This substantially continuous reduction makes it possible to avoid congestion of the fill product, or excessive squashing, or the subjection of the fill product to excessive pressure. The reduction in cross section from the aperture 14 to the connecting aperture 22 is, in some embodiments, substantially linear. In this reduction, the upper boundary of the fill product channel 2 in the area of the dosing cylinder 4 is defined by the dosing piston 40 lowered fully to its lower dead center.

At least the siphon-like section 20 of the product channel 2 has a constantly reducing cross section from its beginning as far as the connecting aperture 22, so that the fill product in this area is not excessively congested or squashed, and accordingly it is possible to achieve gentle filling of the fill product.

The reduction of the cross section to the cross section q3 at the outlet end 52 of the discharge channel 5 is used to achieve filling that corresponds to the cross section of the mouth of the container 110 that is to be filled, while at the same time enabling an adequate volume of fill product to be accommodated in the dosing cylinder 4 without requiring the height of the device 100 to be excessive. To achieve this, a larger cross section of the dosing cylinder 4, and hence also of the aperture 14, is provided.

FIG. 2 shows a second operating state of the device 100, in which the valve 3 is closed and accordingly the connection between the fill product reservoir 1 and the product channel 2 is closed. The dosing piston 40 is moving downwards, causing the fill product accommodated in the dosing cylinder 4 to flow to the connecting aperture 22 in the discharge channel 5, via the product channel 2 and in particular its siphon-like section 20, and then enter, through the outlet end 52, the schematically shown container 110 that is to be filled. At this time the discharge plunger 50 is in a position in which it is drawn back in an upwards direction, so that it aligns substantially with the upper rim of the connecting aperture 22. The fill product accordingly flows unhindered through the discharge channel 5 into the container 110 that is to be filled.

If the dosing piston 40 has arrived at its lower dead center, with the result that no further fill product is conveyed through the product channel 2, the discharge plunger 50 is again controlled to adopt its lowered position, with the fill product that is still present in the discharge channel 5 at this time being expelled through the outlet end 52. Thus the discharge channel 5 is fully emptied of fill product, with the result that a defined filling of the container to be filled 110 is achieved.

If the fill product contains solids or particles, such as for example pieces of fruit, whole fruits, chocolate, muesli or other solids, the particles that are in the area of the shearing edge 54 are sheared off at the shearing edge 54 during the descent of the discharge plunger 50. This takes place in such a manner that the particles are not squashed but are cut with a clean edge. This is particularly important when fill products with larger fruit pieces or whole elastic fruits, such as for example cherries, are filled, since the particles present in the fill product are not squashed in this case. Instead, only a few cleanly cut particles are present alongside the whole particles.

The lowering of the discharge plunger 50 in the discharge channel 5 also closes the connecting aperture 22, so that in the next cycle the valve 3 can be opened and, by means of the raising of the dosing piston 40, the dosing cylinder 4 can again be filled with fill product from the fill product reservoir. This operating state is shown for example in FIG. 1.

With individual control of the discharge plunger 50, it can further be achieved that if there is a gap in the supply of containers in a production plant, meaning that there is no container below the outlet end 52 during production operations, the discharge plunger 50 remains in the lowered position during the entire production cycle, so that no fill product is discharged. This makes it possible to prevent fill product from contaminating the environment if it is not collected by a container that is to be filled. The outlet end 52 can accordingly be kept closed if no container is present.

The discharge plunger 50 can also be used as overload protection or an overload indicator, in the event that the outlet end 52 is blocked, for example by jammed fill product or other foreign bodies, with the result that too great a force would be needed to lower the discharge plunger 50. In the event of an overload caused by blockage of the outlet end 52 or the mouth of the discharge channel 5, by for example a foreign body that has reached the discharge channel, movement of the discharge plunger 50 cannot continue beyond the point at which a certain opposing force in its actuator is exceeded. This makes it possible to limit, or entirely prevent, possible mechanical damage to the device 100. By monitoring the position of the discharge plunger 50 at predetermined positions on the circumference of the rotating device, it is possible to determine whether such a fault is present in an individual device 100, i.e. in a particular filling element. The fault can thus be unambiguously attributed to a particular device 100, and rectification action can accordingly proceed immediately on this device after the plant is stopped.

If the discharge plunger 50 has an electromagnetic or electromotive actuator or drive, overload protection can be integrated in a simple manner to give notice, via an electrical sensor signal, of any obstruction of the discharge plunger 50. In this manner it is also possible to carry out targeted actuation or selective actuation, enabling the discharge plunger 50 to be halted in the closed position if there is a gap in the supply of containers, in order to prevent the discharge of fill product in a position in which there is no container.

Figure 3:
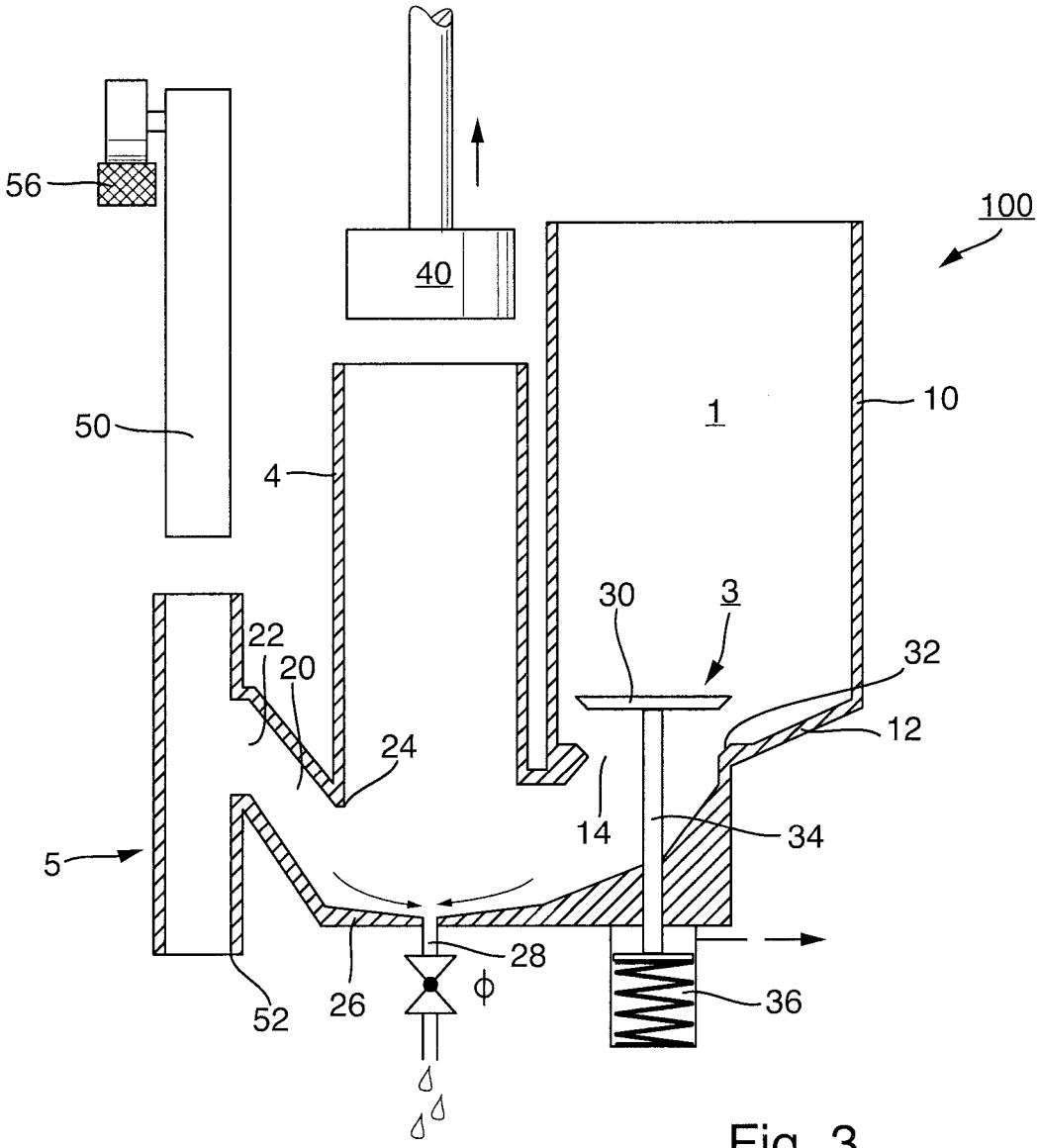
FIG. 3 shows the device in FIGS. 1 and 2 in a third operating state, in which cleaning of the device is carried out.

FIG. 3 shows the device 100 during a cleaning process. Valve 3 is fully open, allowing a cleaning medium to flow from the fill product reservoir 1 through the annular gap in the valve 3 into the product channel 2. In addition the dosing piston 40 is lifted fully out of the dosing cylinder 4, so that here too full cleaning of both the inner surfaces of the dosing cylinder 4 and the outer surfaces of the dosing piston 40 can be carried out in a simple manner by impingement with a cleaning medium. Furthermore, the discharge plunger 50 is lifted fully out of the discharge channel 5, so that here again both the discharge channel 5 and the discharge plunger 50 can be cleaned—at least on the surfaces of each that come into contact with the product—by simple impingement with a cleaning medium.

The drainage aperture 28, and in particular the shut-off device on the drainage aperture 28, are open, in order to allow the cleaning medium to flow out. Because the drainage aperture 28 is disposed at the lowest point of the product channel 2, it can also be achieved that residue of fill product can reliably flow out along with all of the cleaning medium, and accordingly the cleaning can be carried out in full. This additionally avoids cleaning medium or rinsing water remaining in the product channel 2, which could cause problems during subsequent operation of the device 100, and lead to the carry-over of the applicable media.

In order to clean the valve 3 it is unnecessary to dismantle it, as is the case with the rotary valves in the state of the art. Instead, due to the fact that fluid can flow around all surfaces of valve 3 that come into contact with the product, valve 3 can be cleaned while it is accommodated in the device 1, provided that it is open.

Furthermore, it is not necessary to disassemble device 100, and in particular its basic structure, on which for example the walls of the product channel 2, the walls of the fill product reservoir 1, the dosing cylinder 4 and the discharge channel 5 are provided, as shown for example in FIG. 3. Instead, device 100 can remain in this configuration. In particular, it is also possible during cleaning to allow these components to remain as a single piece or fixedly connected, for example bolted or welded to each other. Accordingly, it is possible to dispense with the time-consuming cleaning process known from the state of the art, in which various levels of the device 100 need to be detached.

To the extent applicable, all features described in the individual example embodiments can be combined with each other and/or exchanged, without departing from the field of the invention.

The invention claimed is:

1. A device for filling a container with a fill product comprising:

a fill product reservoir comprising a valve disposed in a base of the fill product reservoir;

a dosing cylinder comprising a dosing piston configured to be displaceable for dosing the fill product; and a discharge channel comprising an outlet end that discharges the fill product into the container and a discharge plunger that expels a product residue at an end of a filling process, wherein:

the fill product reservoir, the dosing cylinder, and the discharge channel are in communication with each other via a product channel, the valve opens and closes a connection between the fill product reservoir and the product channel, the discharge channel is in communication with the dosing cylinder via an inclined section of the product channel, a lower blocking edge of the inclined section is disposed at a level below a level defined by a lower center of the dosing piston, a lower edge of a wall of the dosing cylinder proximate to the fill product reservoir is disposed at a level that is higher than the lower blocking edge of the inclined section, at the end of the filling process, when no further fill product is being conveyed through the product channel, the discharge plunger, by adopting its lowered position, is configured to expel fill product that is still present in the discharge channel through the outlet end, and an aperture in the base of the fill product reservoir is disposed at a higher level than the level defined by the lower center of the dosing piston.

2. The device of claim 1, wherein the valve comprises a seat valve, a poppet valve, or both.

3. The device of claim 1, wherein the valve comprises a valve disk configured to be lowered sealingly into a valve seat disposed in the aperture.

4. The device of claim 1, wherein the valve is actuated individually by a mechanical, pneumatic, electropneumatic, electromotive or electromagnetic drive.

5. The device of claim 1, wherein the inclined section tapers from an end that faces the dosing cylinder to an end that faces the discharge channel.

6. The device of claim 1, further comprising a shearing edge disposed between the inclined section and the discharge channel, wherein the shearing edge cooperates with the discharge plunger.

7. The device of claim 1, further comprising a drainage aperture configured to be closed by means of a shut-off device, wherein the drainage aperture is disposed in a base of the product channel.

8. The device of claim 1, wherein the discharge plunger is actuated individually by a mechanical, pneumatic, electropneumatic, electromotive or electromagnetic drive.

9. The device of claim 8, wherein a control of the drive is configured such that if there is a gap in a supply of containers, the discharge plunger remains in a lowered position.

10. The device of claim 1, wherein the valve is controlled to adopt an open position during cleaning of the device.

11. A device for filling a container with a fill product comprising:

a fill product reservoir comprising a valve and an aperture, the valve and aperture each disposed in a base of the fill product reservoir;

a dosing cylinder comprising a dosing piston configured to be displaceable for dosing the fill product; and a discharge channel comprising an outlet end that discharges the fill product into the container and a discharge plunger that expels a product residue at an end of a filling process, wherein:

the fill product reservoir, the dosing cylinder, and the discharge channel are in communication with each other via a product channel, the product channel extending from the aperture to the discharge channel, the valve opens and closes a connection between the fill product reservoir and the product channel, the discharge channel is in communication with the dosing cylinder via an inclined section of the product channel, a lower blocking edge of the inclined section is disposed at a level below a level defined by a lower center of the dosing piston, a lower edge of a wall of the dosing cylinder proximate to the fill product reservoir is disposed at a level that is higher than the lower blocking edge of the inclined section, at the end of the filling process, when no further fill product is being conveyed through the product channel, the discharge plunger, by adopting its lowered position, is configured to expel fill product that is still present in the discharge channel through the outlet end, and the aperture is disposed at a higher level than the level defined by the lower center of the dosing piston.

12. The device of claim 11, wherein the valve comprises a valve disk and a valve seat, the valve seat disposed around a circumference of the aperture.

13. The device of claim 11, wherein the inclined section is connected to the discharge channel via a connecting aperture.

14. The device of claim 13, further comprising a shearing edge formed in an area of the connecting aperture.

15. The device of claim 13, wherein the product channel has a larger cross section in an area of the aperture than in an area of the connecting aperture.

16. The device of claim 13, wherein the outlet end has a smaller cross section than a cross section of the connecting aperture.

17. The device of claim 1, wherein the inclined section is adjacent to the dosing cylinder and the discharge channel.

18. The device of claim 11, wherein the inclined section is adjacent to the dosing cylinder and the discharge channel.

* * * * *